US005215245A

United States Patent [19]

Moyer

[11] Patent Number: 5,215,245

[45] Date of Patent: Jun. 1, 1993

[54] METHOD FOR ROLL EMBOSSING METAL STRIP

[75] Inventor: Ross A. Moyer, Syracuse, N.Y.

[73] Assignee: Carrier Corporation, Syracuse, N.Y.

[21] Appl. No.: 679,985

[22] Filed: Apr. 3, 1991

[51] Int. Cl.[5] ..... B21C 37/08; B23K 101/08; B21D 53/06

[52] U.S. Cl. ..... 228/152

[58] Field of Search ..... 228/152

[56] References Cited

U.S. PATENT DOCUMENTS

| | | | |
|---|---|---|---|
| 3,603,498 | 9/1971 | Cook | 228/3.1 |
| 3,906,605 | 9/1975 | McLain | 228/152 |
| 3,921,883 | 11/1975 | McLain | 228/152 |
| 4,306,619 | 12/1981 | Trojani | 165/179 |
| 4,480,684 | 11/1984 | Onishi et al. | 165/179 X |
| 4,809,415 | 3/1989 | Okayama et al. | 29/157.3 |

*Primary Examiner*—Kenneth J. Ramsey

[57] ABSTRACT

A method for roll embossing an enhancement pattern into a surface of a metal strip. The method is intended for use in manufacturing roll formed seam welded metal tubing having interior or exterior surface enhancements to improve the heat transfer characteristics of the tube. Metal strip produced by use of the method has a weld zone adjacent each edge of the strip that does not have the surface pattern embossed upon it but has been rolled to a thickness less than the initial thickness of the strip feedstock. The amount by which the rolled thickness of the strip in the weld zones is reduced from the initial thickness is such that the portions of the strip in the weld zones undergo the same elongation as the central portion of the strip which receives the roll embossed surface enhancement. In this way no tensile stresses are introduced into the weld zone and it has a uniform and predictable thickness that will ensure a good welded seam during later welding into finished tubing.

1 Claim, 1 Drawing Sheet

METHOD FOR ROLL EMBOSSING METAL STRIP

BACKGROUND OF THE INVENTION

This invention relates generally to a method for roll embossing metal strip. More particularly, the invention relates to a method that results in uniform and predictable edge thicknesses and prevents the formation of tensile stresses in the roll embossed strip, thus assuring good weldability at the edges of the strip.

One method of manufacturing metal tubing, e.g. copper or aluminum tubing used in tubed liquid-to-air or liquid-to-liquid heat exchangers, is by roll forming and welding metal strip. The strip is first longitudinally roll formed into a circular cross section in a tube forming mill. The opposite edges of the strip, constituting after roll forming a longitudinal seam, are then welded to form the tube. The two strip edges must be of a uniform and adequate thickness in order to obtain a good seam weld.

Grooving or ribbing the interior or exterior surfaces of a heat exchanger tube usually improves the heat transfer efficiency of the tube so enhanced. The specific mechanisms by which the heat transfer performance of a given tube is improved by surface enhancements vary with specific applications. In general, however, tube surface enhancements increase heat transfer performance by increasing the heat transfer area of the tube and by promoting fluid flow conditions that are conducive to heat transfer between the fluids in contact with the surfaces of the tube.

There are numerous techniques for enhancing the surface or surfaces of a tube. One method, particularly suitable for enhancing tubing formed from rolled and welded strip, is to place the enhancements on one or both sides of the strip before the strip is formed into a tube. In a modern high speed tube manufacturing process using continuous strip feedstock, the surface enhancing can be accomplished by placing a roll embossing machine downstream of the strip supply and upstream of the tube forming mill. The roll embossing machine can then form surface enhancements on a sides or sides of the strip before the strip enters the tube forming step of the process.

Roll embossing of a strip can result in an elongation of the strip. For example, one length unit of metal feedstock entering the inlet of the roll embossing machine can exit the outlet of the machine as 1.2 length units of embossed strip. It may be that the minimum thickness of the strip in the area that is embossed will provide adequate wall thickness in the finished tube but is not adequate to provide for good weld strength in the weld zone at the strip edge. In this case, a weld zone in which there is no surface enhancement is left at each edge of the strip. If these weld zones receive no treatment in the roll embossing machine, they will not be elongated.

If the central portion of the strip is embossed, and therefore elongated, but the weld zones at the edges are not, tensile stresses will be introduced into the weld zones. These stresses may become relieved by deformation of the strip edges in unpredictable ways, resulting in nonlinear edges with nonuniform thicknesses. Such discontinuities and nonuniformities will result in difficulties in presenting a consistent, predictable seam to the seam welder and thus can adversely impact the ability to get a good weld joint during later seam welding of the roll formed strip into finished tubing. This problem is particularly serious in the high speed, automatic welding processes used in modern tubing manufacturing lines.

SUMMARY OF THE INVENTION

An object of the present invention is to prevent the nonuniform elongation of metal strip as it is roll embossed with a surface enhancement on its central portion but with a weld zone of no surface enhancement adjacent each edge.

Another object of the present invention is to produce a metal strip having a rolled embossed enhancement on a central portion of the strip but with a weld zone of uniform thickness adjacent each edge having no roll embossed surface enhancement.

The present invention achieves these and other objects in a method for roll embossing metal strip in which the amount of elongation in a metal strip that has been roll embossed with a surface enhancement over its entire surface is first determined. Then, during rolling of strip having no surface enhancement roll embossed on a weld zone adjacent each edge, the weld zones are rolled to a thickness that results in an elongation in the weld zones that is approximately the same as the elongation produced by roll embossing the surface enhancement into the central portion of the strip surface.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENT

Figure 1:
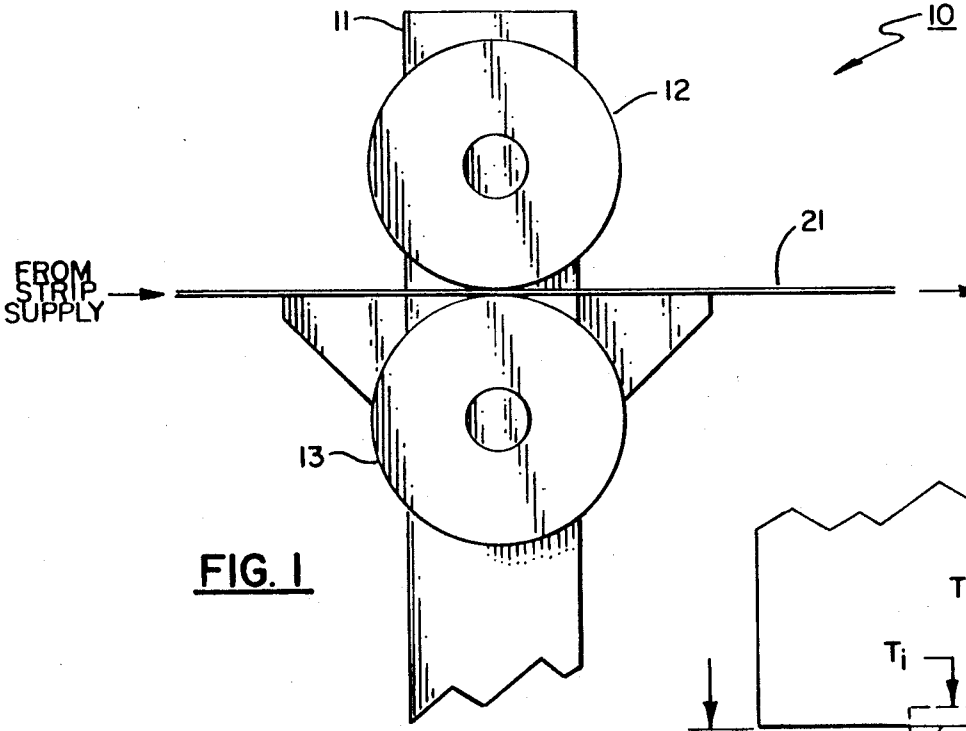
FIG. 1 is a schematic of a portion of a roll formed seam welded tubing manufacturing line.

FIG. 1 depicts schematically a portion of a roll formed seam welded tubing manufacturing line and shows the principal parts and relative location of a roll embossing machine used in practicing the method of the present invention. Roll embossing machine 10 is placed downstream from the supply of flat metal strip 21 and upstream from the roll forming mill in the manufacturing line so that a surface enhancement can be embossed into the strip before it is formed into a tube and then welded. Roll embossing machine 10 comprises foundation and support 11, working roller 12 and backing roller 13. When the manufacturing line, including roll embossing machine 10 is in operation, strip 21 passes between working roller 12 and backing roller 13. Machined into the circumferential surface of working roller 12 is a reverse or mirror image of the desired surface enhancement pattern so that as strip 21 passes through roll embossing machine 10, the pattern is embossed into the strip. To emboss the pattern into the strip, working roller 12 must exert relatively high pressure forces on strip 21. These forces may be achieved by mechanical, hydraulic or other suitable means (not shown). If the tubing produced by the manufacturing line is to have surface enhancements on both its interior and exterior surfaces, then backing roller 13 would be replaced by a second working roller.

Figure 2:
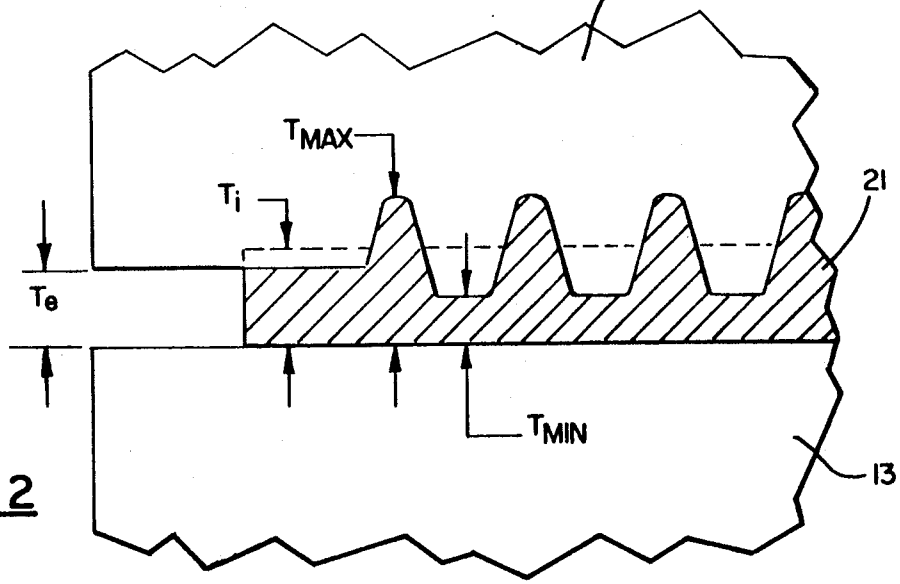
FIG. 2 is a cross sectional view of a portion of a metal strip being rolled according to the method of the present invention.

FIG. 2 depicts a cross section of a portion of metal strip 21 being rolled between working roller 12 and backing roller 13 according to the method of the present invention. Setup tests or calculations have determined the amount of elongation resulting from roll embossing the entire surface of a strip having an initial thickness $T_i$ with an enhancement pattern having areas of minimum thickness $T_{min}$ and areas of maximum thickness $T_{max}$. Then, during the production roll embossing process, the weld zone adjacent each edge of strip 21 is rolled to a thickness $T_e$ that will result in an elongation of the weld zone that is approximately equal to the elongation produced by roll embossing the central portion of the strip. In this way, the entire strip is elongated uniformly by the roll embossing process, there are no tensile stresses introduced into the weld zones and the strip edges remain linear and have predictable, uniform thicknesses, thus enabling a good weld during later seam welding of the roll formed tubing.

The amount of rolling that the weld zone will require to be elongated the same amount as the central portion of the strip depends on the surface enhancement that is rolled on to the central portion. In general, a more pronounced enhancement will result in more central portion elongation and therefore, more reduction in weld zone thickness will be required to achieve an equal amount of weld zone elongation.

It has been determined that when rolling an enhancement that will result in a given number of axially oriented internal fins in a heat transfer tube, the amount of weld zone thickness reduction required is directly proportional to the height ($H_f$) (where $H_f = T_{max} - T_{min}$) of the fins being produced. For example, when rolling 72 axial fins into a nominal 0.508 mm (0.020 inch) thick feedstock strip of appropriate width to be roll formed and seam welded into a nominal 9.5 mm (0.375 inch) outer diameter tube, the desired rolled weld zone thickness ($T_e$) ranges from 0.0495 mm (0.0196 inch) for a fin height ($H_f$) of 0.0254 mm (0.001 - inch) to 0.396 mm (0.0156 inch) for a fin height ($H_f$) of 0.254 mm (0.01 inch).

This embodiment is illustrative of the method of the present invention but the scope of the invention should be limited only by the below claims.

What is claimed is:

1. A method for roll embossing a surface enhancement on a central portion of a metal strip having a surface and edges while leaving a weld zone with no surface enhancement adjacent each of said edges comprising the step of:

rolling said weld zone so that said weld zone undergoes a substantially equivalent amount of elongation, when rolled, as the elongation produced by roll embossing said surface enhancement on said central portion.

* * * * *